US010721982B2

(12) United States Patent
Cardona

(10) Patent No.: US 10,721,982 B2
(45) Date of Patent: Jul. 28, 2020

(54) HAIRPIECE HAVING PERIMETER WITH PASS-THROUGH OPENINGS

(71) Applicant: HAIRUWEAR INC., Lenexa, KS (US)

(72) Inventor: Ciomara Cardona, Sunrise, FL (US)

(73) Assignee: HAIRUWEAR INC., Lenexa, KS (US)

( * ) Notice: Subject to any disclaimer, the term of this patent is extended or adjusted under 35 U.S.C. 154(b) by 487 days.

(21) Appl. No.: 15/490,647

(22) Filed: Apr. 18, 2017

(65) Prior Publication Data

US 2018/0295914 A1 Oct. 18, 2018

(51) Int. Cl.
*A41G 5/00* (2006.01)

(52) U.S. Cl.
CPC ..... *A41G 5/008* (2013.01)

(58) Field of Classification Search
CPC .... A41G 5/008; A41G 3/0058; A41G 3/0025; A41G 5/0033; A41G 5/0053; A41G 3/0041; A41G 3/00; A41G 3/0008; A41G 5/004
USPC ..... 132/84, 201, 53
See application file for complete search history.

(56) References Cited

U.S. PATENT DOCUMENTS 4,799,502 A 1/1989 Kobayashi et al.
5,303,724 A * 4/1994 Anzivino ..... A41G 3/0033 132/275
5,368,052 A * 11/1994 Finamore ..... A41G 5/0006 132/53
5,855,211 A 1/1999 Nelson
6,170,491 B1 1/2001 Maekawa
6,267,118 B1 7/2001 Ito et al.
6,352,079 B1 3/2002 Bate
6,513,535 B1 2/2003 Lane
6,629,536 B1 10/2003 Lane
7,150,282 B2 12/2006 Lane
7,174,899 B2 2/2007 Lane
7,174,900 B2 2/2007 Lane et al.
(Continued)

FOREIGN PATENT DOCUMENTS

KR 20060104184 10/2006
WO 2008000363 A1 1/2008
(Continued)

OTHER PUBLICATIONS

PCT Application No. PCT/US2017/034180, International Search Report and Written Opinion dated Sep. 1, 2017, 13 pages.
(Continued)

*Primary Examiner* — Nicholas D Lucchesi
(74) *Attorney, Agent, or Firm* — Lathrop GPM, LLP

(57) ABSTRACT

One hair addition has a net with a central portion, a perimeter portion encircling the central portion, an upper face, and a lower face. A polymer base having an outer boundary extends below the net lower face at the entire net perimeter portion. The polymer base has upper and lower faces and a generally uniform total thickness therebetween, and the net central portion is devoid of the polymer base. Hair strands extend from the net central portion. A ribbon has first and second ends and a middle portion, and the first and second ribbon ends are fused to the polymer base. First and second cuts respectively extend from the outer boundary through the polymer base and the net. The first and second cuts are positioned above the ribbon and define lateral ends of a flap.

21 Claims, 15 Drawing Sheets

(56) References Cited

U.S. PATENT DOCUMENTS

| | | | | |
|---|---|---|---|---|
| 7,278,432 | B2 | 10/2007 | Lane | |
| 7,735,495 | B2 | 6/2010 | Lane et al. | |
| 7,743,774 | B2 | 6/2010 | Lane | |
| 8,434,500 | B2 | 5/2013 | Alex et al. | |
| 8,567,413 | B2 | 10/2013 | Lane | |
| 9,167,858 | B2 | 10/2015 | Lane | |
| 9,241,525 | B2 | 1/2016 | Alex et al. | |
| 9,700,092 | B2 * | 7/2017 | Alex | A41G 5/002 |
| 2005/0252518 | A1 | 11/2005 | Salinas | |
| 2005/0268928 | A1 | 12/2005 | Lane | |
| 2007/0221239 | A1 * | 9/2007 | Lee | A41G 5/004 132/201 |
| 2010/0170527 | A1 | 7/2010 | Toba | |
| 2010/0229883 | A1 | 9/2010 | Lane et al. | |
| 2013/0032162 | A1 * | 2/2013 | Major | G09B 19/00 132/54 |
| 2013/0048002 | A1 | 2/2013 | Alex | |
| 2017/0095026 | A1 | 4/2017 | Chung | |

FOREIGN PATENT DOCUMENTS

| | | | |
|---|---|---|---|
| WO | 2011120599 | A1 | 10/2011 |
| WO | 2016021827 | A1 | 2/2016 |
| WO | 2016043995 | A2 | 3/2016 |

OTHER PUBLICATIONS

Breathable Monofilament Mesh Base Men's Toupee, Crown LaceWig, Dec. 2016, 2 pages, http://www.crownlacewig.com/?products+breatherable-monifilament-mesh-base-mens-toupee>.

* cited by examiner

HAIRPIECE HAVING PERIMETER WITH PASS-THROUGH OPENINGS

BACKGROUND

The disclosed subject matter is directed to hair additions, which are devices having real or synthetic hair that are worn on a user's head to complement, accent, or otherwise alter the appearance of the user's hair.

A prior art device disclosed in US 2013/0048002 has a circumference 7, a boundary area 4 extending along the circumference 7, a net 3 with hairs 2 attached, and a flat material 5 beneath the net 3 in the boundary area 4. The reference numbers used to discuss the prior art device are those found in US 2013/0048002. Slots 6 are formed in the flat material 5, and two cuts in the net 3 extend from each slot 6. From the bottom, the resulting structure has a continuous foundation with slots 6 for passing hair therethrough; and from the top, the net 3 forms a flap 10 extending from each slot 6. Adhesive 9 on the bottom of each flap 10 and on an opposite face of the flat material 5 is used to fix the device to the wearer's hair that is passed through the slots 6 and under the flaps 10. But cutting the net 3 can result in an undesirable distribution of hairs 2 at the cuts, and the combination of the slots 6 in the flat material 5 and the cuts in the net 3 may be difficult to manufacture and/or render the device undesirably unresilient. Moreover, the even distribution of hair 2 throughout the entire device (before making the cuts) may be unnecessary, undesirable, and/or not cost effective.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

According to one embodiment, a hair addition has a net with a central portion and a perimeter portion encircling the central portion, a polymer base encasing the net at the entire net perimeter portion, and hair strands extending from the net central portion. The polymer base has upper and lower faces and a generally uniform total thickness therebetween. Additional hair strands extend from the polymer base upper face. The net central portion is devoid of the polymer base, and the net perimeter portion is devoid of hair strands. A slot extends through only a lower thickness of the polymer base, and first and second cuts respectively extend from the slot through only an upper thickness of the polymer base. The lower thickness and the upper thickness combine to define the total thickness. The first and second cuts define lateral ends of a flap overlaying a strip. The strip has a part of the net perimeter portion contained therein, and the flap is devoid of the net.

According to another embodiment, a hair addition has a net with a central portion, a perimeter portion encircling the central portion, an upper face, and a lower face. A polymer base is coupled the net lower face at the entire net perimeter portion. The polymer base has an outer boundary, and the net central portion is devoid of the polymer base. Hair strands extend from the net central portion and the net perimeter portion. A ribbon has first and second ends and a middle portion, and the first and second ribbon ends are fused to the polymer base. First and second cuts respectively extend from the outer boundary through the polymer base and the net. The first and second cuts are positioned above the ribbon and define lateral ends of a flap.

According to still another embodiment, a hair addition has a net with a central portion, a perimeter portion encircling the central portion, an upper face, and a lower face. A polymer base having an outer boundary extends below the net lower face at the entire net perimeter portion. The polymer base has upper and lower faces and a generally uniform total thickness therebetween, and the net central portion is devoid of the polymer base. Hair strands extend from the net central portion. A ribbon has first and second ends and a middle portion, and the first and second ribbon ends are fused to the polymer base. First and second cuts respectively extend from the outer boundary through the polymer base and the net. The first and second cuts are positioned above the ribbon and define lateral ends of a flap.

According to yet another embodiment, a hair addition has a net with a central portion and a perimeter portion encircling the central portion. The net further includes an upper face and a lower face, and a polymer base extends below the net lower face at the entire net perimeter portion. The polymer base has upper and lower faces and a generally uniform total thickness therebetween, and the net central portion is devoid of the polymer base. Hair strands extend from the net central portion. A slot extends through only a lower thickness of the polymer base, and first and second cuts respectively extend from the slot through only an upper thickness of the polymer base. The lower thickness and the upper thickness combine to define the total thickness, and the first and second cuts define lateral ends of a flap overlaying a strip. The strip has a part of the net perimeter portion contained therein, and the flap is devoid of the net. Additional hair strands extend from the polymer base upper face.

DETAILED DESCRIPTION

FIGS. 1-6 disclose a hair addition 100 according to one embodiment of the current invention. The hair addition 100 includes a net 110 and a polymer base 120. The net 110 has an upper face 110*a*, a lower face 110*b*, a central portion 110*c*, and a perimeter portion 110*d* encircling the central portion 110*c*.

Figure 1:
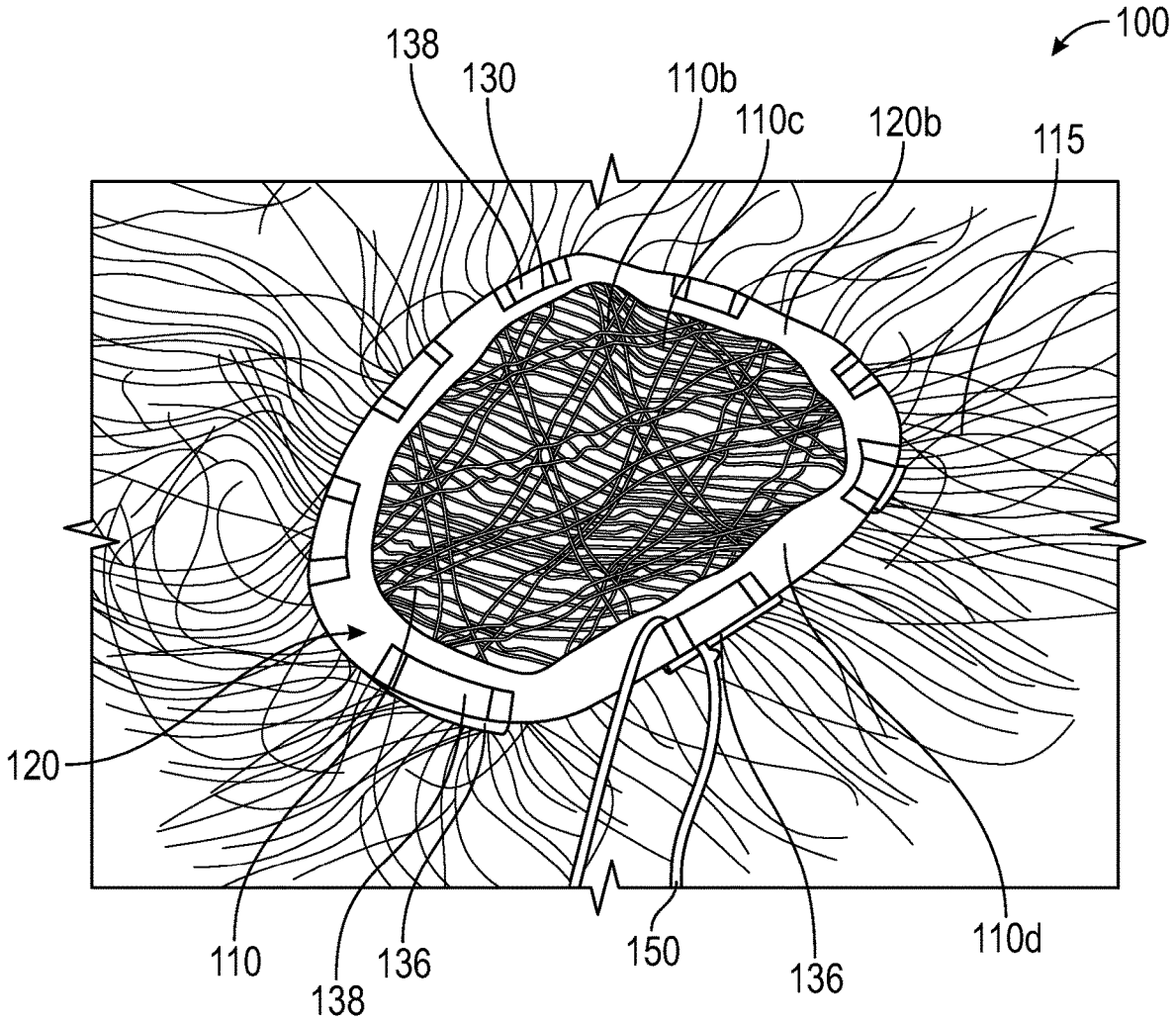
FIG. 1 shows a hair addition according to one embodiment of the current invention, from a bottom side.
Figure 2:
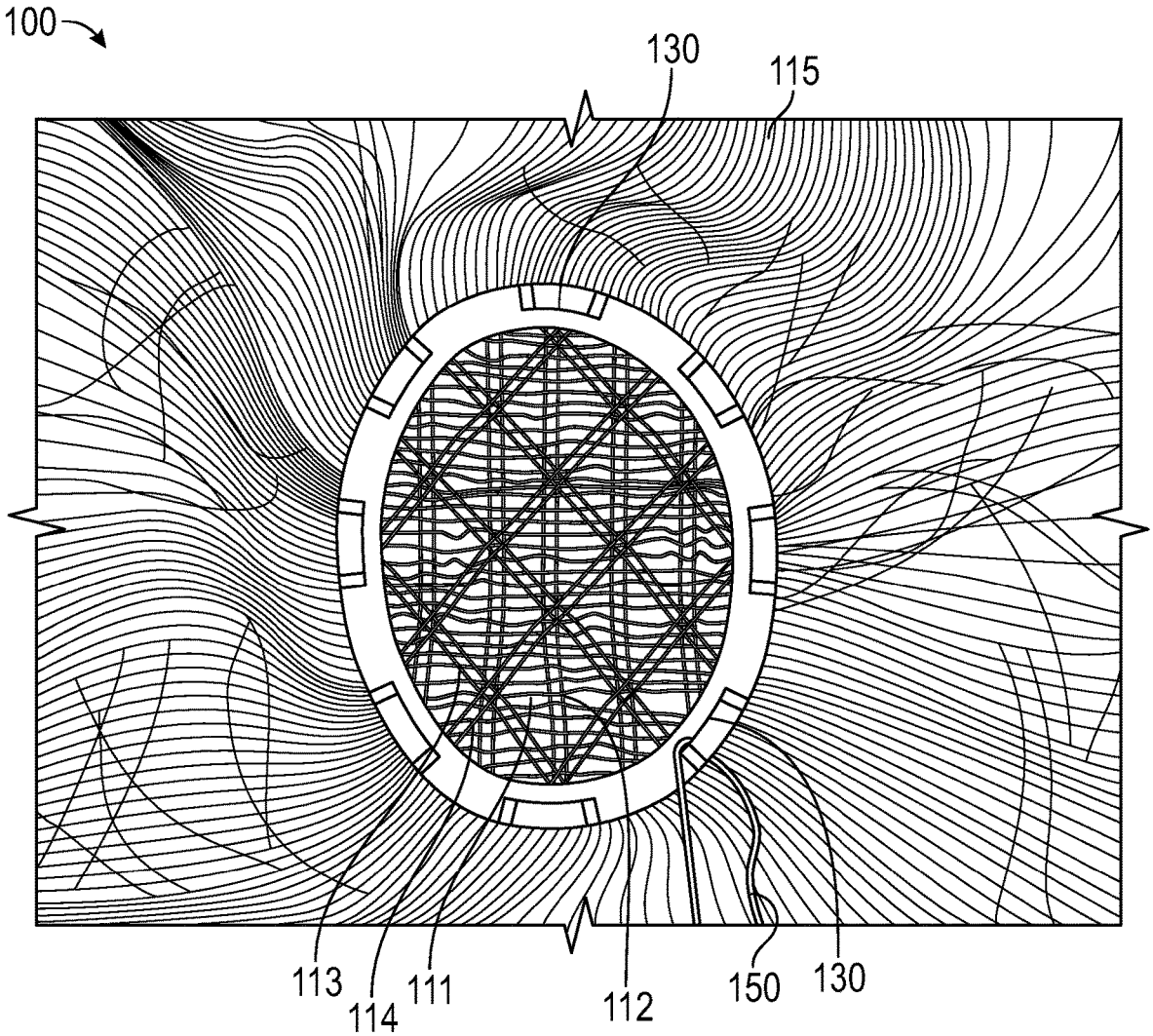
FIGS. 2-4 are bottom views of the hair addition of FIG. 1.
Figure 3:
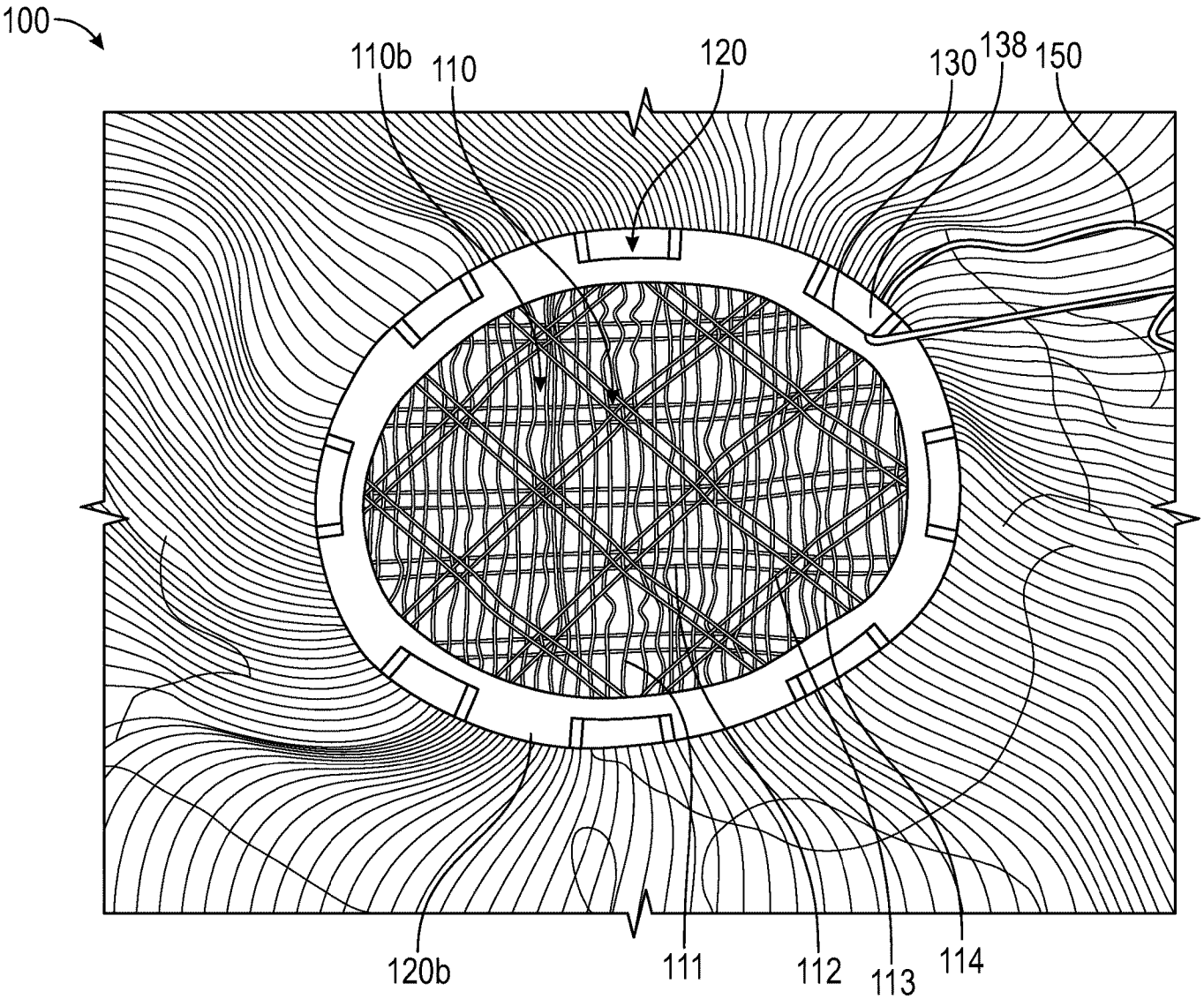
Figure 4:
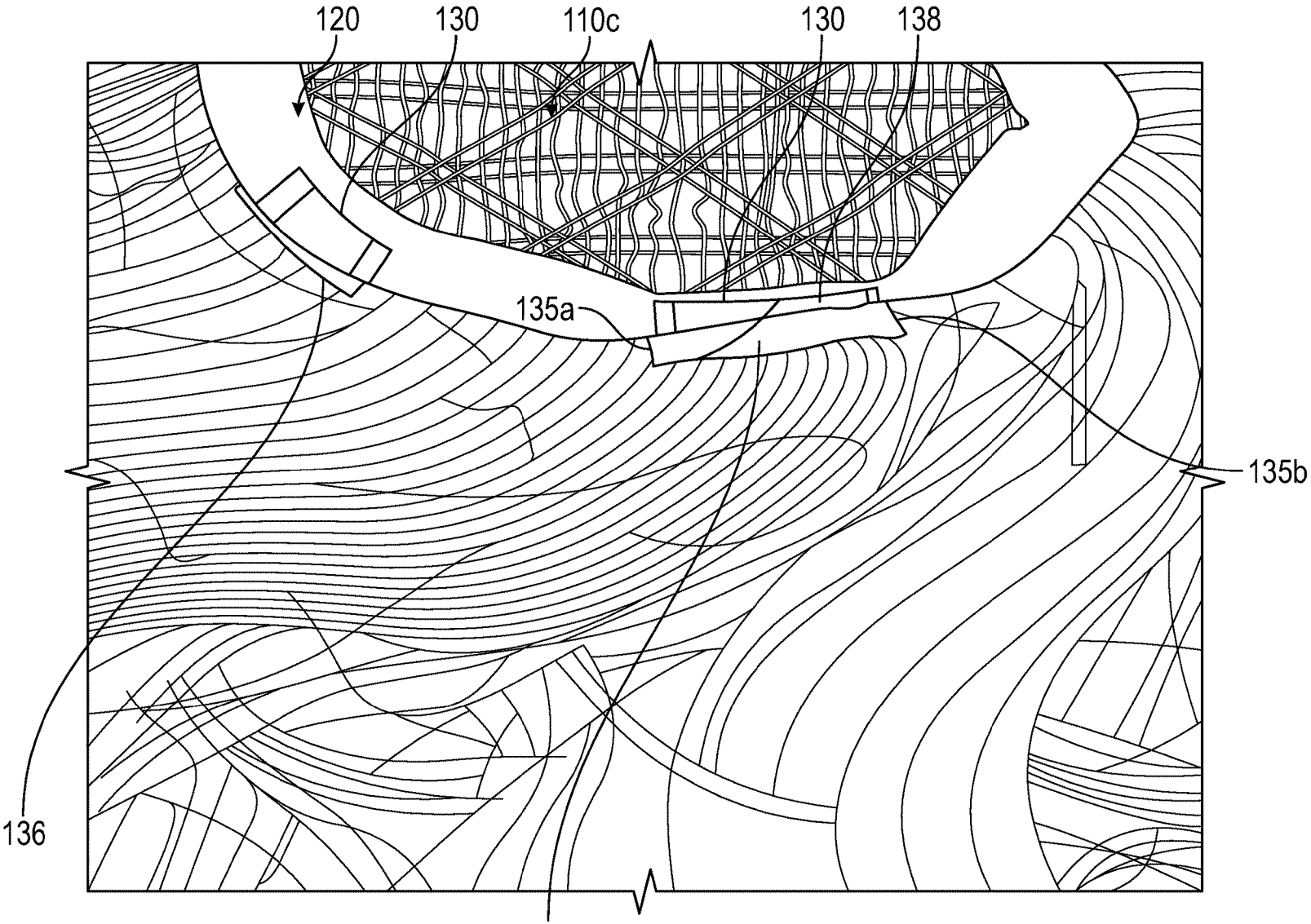

As shown in FIG. 2, it may be desirable for the net 110 to have a plurality of first, second, third, and fourth strands 111, 112, 113, 114. The first strands 111 are generally parallel to one another and regularly spaced apart at a first distance, and the second strands 112 are generally parallel to one another and generally perpendicular to the first strands 111. The third strands 113 are generally parallel to one another and are angularly offset between about thirty degrees and about sixty degrees from the first strands 111, and the fourth strands 114 are generally parallel to one another and are generally perpendicular to the third strands 113. In some embodiments, it may be desirable for the third strands 113 to be angularly offset about forty-five degrees from the first strands 111.

Hair strands 115 in the embodiment 100 extend from the net central portion 110*c*, and the net perimeter portion 110*d* is devoid of hair strands. It may be desirable in some embodiments for hair strands 115 to be coupled to the first strands 111 at the net central portion 110*c*, and for the second, third, and fourth strands 112, 113, 114 to be devoid of hair strands. The hair strands 115 may be natural or synthetic hair strands, and may be any desirable color, length, or shape.

Figure 6:
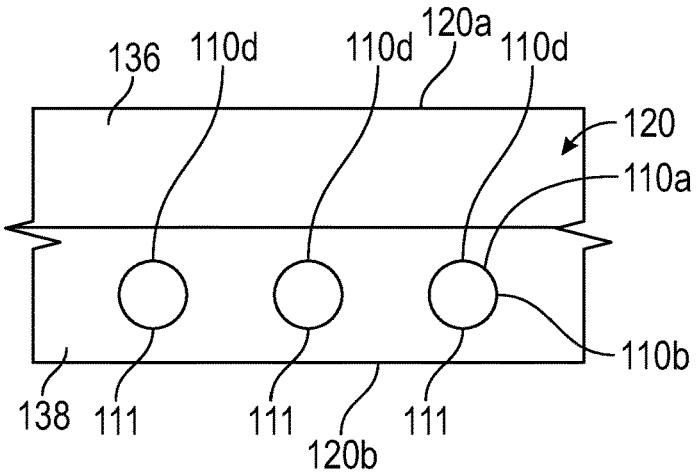
FIG. 6 is a partial section view of the hair addition of FIG. 1.

The polymer base 120 extends below and above the net 110 (e.g., such that the polymer base 120 encases the net 110) at the entire net perimeter portion 110*d*, and the net central portion 110*c* is devoid of the polymer base 120. The polymer base 120 has upper and lower faces 120*a*, 120*b* and a generally uniform total thickness between the faces 120*a*, 120*b* (FIG. 6). It may be particularly desirable for a lower thickness of the polymer base 120 to encase the net 110, and for an upper thickness of the polymer base 120 to extend above the net 110 (with the lower and upper thicknesses combining to define the total thickness of the base 120). In some embodiments, the polymer base 120 includes cured polyurethane, with the polyurethane being cured after being applied to the net perimeter portion 110*d*.

As shown in FIGS. 1-5, a slot 130 extends through only the lower thickness of the polymer base 120 (i.e., not through the upper thickness of the polymer base 120), and first and second cuts 135*a*, 135*b* respectively extend from the slot 130 through only the upper thickness of the polymer base 120 (i.e., not through the lower thickness of the polymer base 120). The cuts 135*a*, 135*b* define lateral ends of a flap 136 overlying a strip 138, and the strip 138 has part of the net perimeter portion 110*d* contained within it while the flap 136 is devoid of the net 110 (FIG. 6).

Adhesive may be located between the flap 136 and the strip 138 for attaching a wearer's hair passed through the slot 130 to at least one of the flap 136 and the strip 138. In some embodiments, the adhesive may be applied to the polymer base 120 before the hair addition 100 is packaged and sold; in such embodiments, temporary coverings (e.g., removable silicone-coated paper backings) may cover the adhesive until the adhesive is to be used. In other embodiments, the adhesive may be later applied by a user.

While this written description generally refers to one slot 130 (associated with one flap 136 and one strip 138) for convenience, the figures illustrate that multiple slots 130 (each being associated with a flap 136 and a strip 138) may be located along the polymer base 120.

Figure 5:
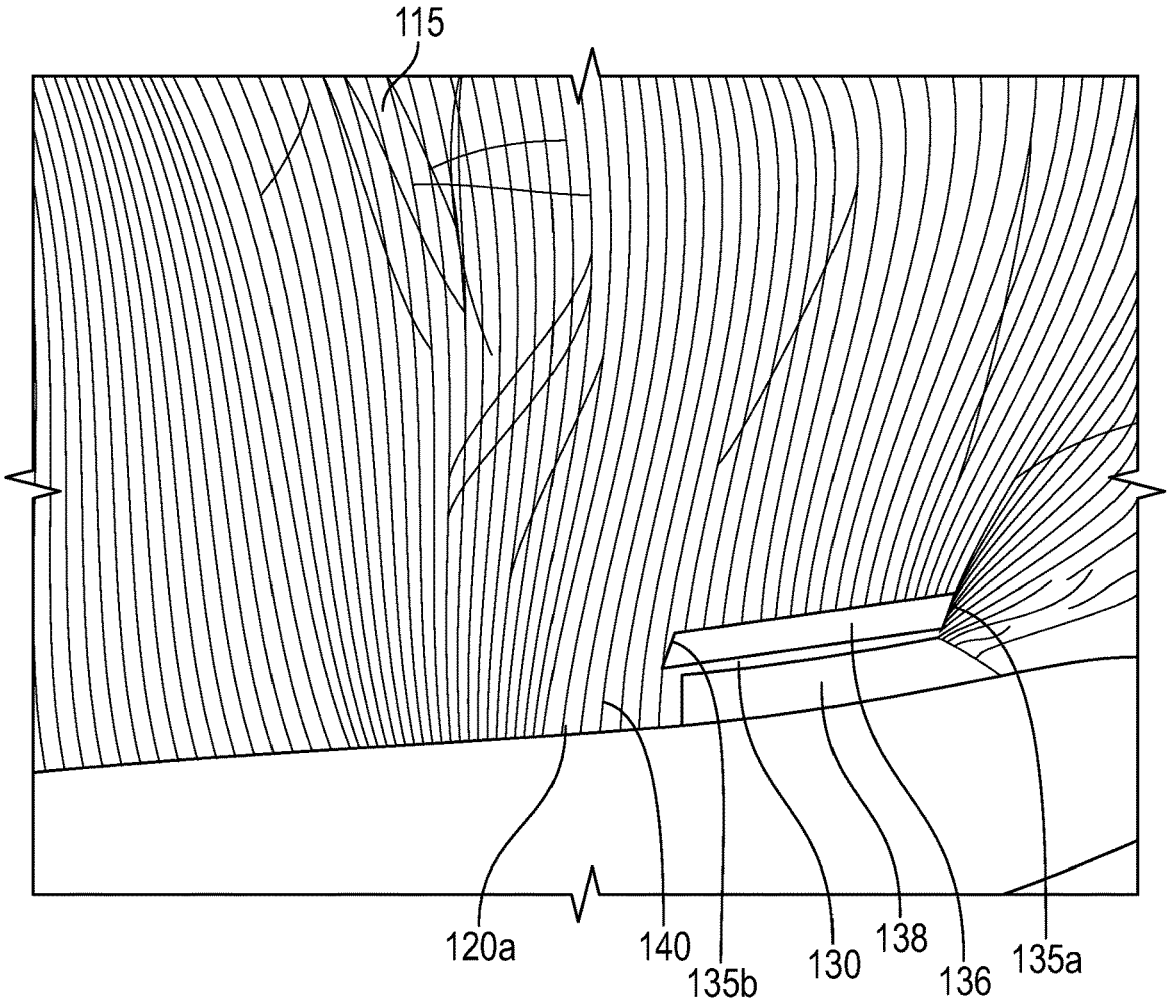
FIG. 5 is a top view of part of the hair addition of FIG. 1.

Turning now to FIG. 5, additional hair strands 140 extend from the polymer base upper face 120*a*. Like the hair strands 115, the additional hair strands 140 may be natural or synthetic hair strands, and may be any desirable color, length, or shape. In addition to being coupled to the polymer base 120 instead of the net 110, the hair strands 140 may primarily differ from the hair strands 115 by being more densely distributed. In other words, it may be particularly desirable for the density of the additional hair strands 140 to be greater than the density of the hair strands 115.

A lanyard 150 (FIGS. 1-3), such as for a hang-tag, may pass through one of the slots 130 for providing advertising, instructional, or other information. Those skilled in the art will appreciate that various forms of packaging may be used.

In use, a hair addition 100 having desired properties (e.g., color, length, and shape of the hair strands 115 and the additional hair strands 140) is selected. The polymer base 120 is positioned atop a wearer's head with the polymer base lower face 120*b* facing the wearer's head. As the polymer base 120 is positioned atop the wearer's head, some of the wearer's hair is passed through the slot 130 and between the flap 136 and the strip 138. The adhesive temporarily fastens the wearer's hair to the flap 136 and the strip 138, keeping the hair addition 100 in place on the wearer's head. As will be appreciated by those skilled in the art, this may be repeated for each slot/flap/strip combination 130/136/138, or for a desired portion of the slot/flap/strip combinations 130/136/138. The construction of the hair addition 100 as described and shown may give it a more natural appearance over prior art devices, and may make it more resilient.

FIGS. 7-13 disclose a hair addition 200 according to another embodiment of the current invention. The hair addition 200 includes a net 210 and a polymer base 220. The net 210 has an upper face 210*a*, a lower face 210*b*, a central portion 210*c*, and a perimeter portion 210*d* encircling the central portion 210*c*. In some embodiments, the net 210 may be constructed of fine monofilament material.

Hair strands 215 in the embodiment 200 extend from the net upper face 210*a* at the net central portion 210*c* and the net perimeter portion 210*d*. The hair strands 215 may be natural or synthetic hair strands, and may be any desirable color, length, or shape.

Figure 13:
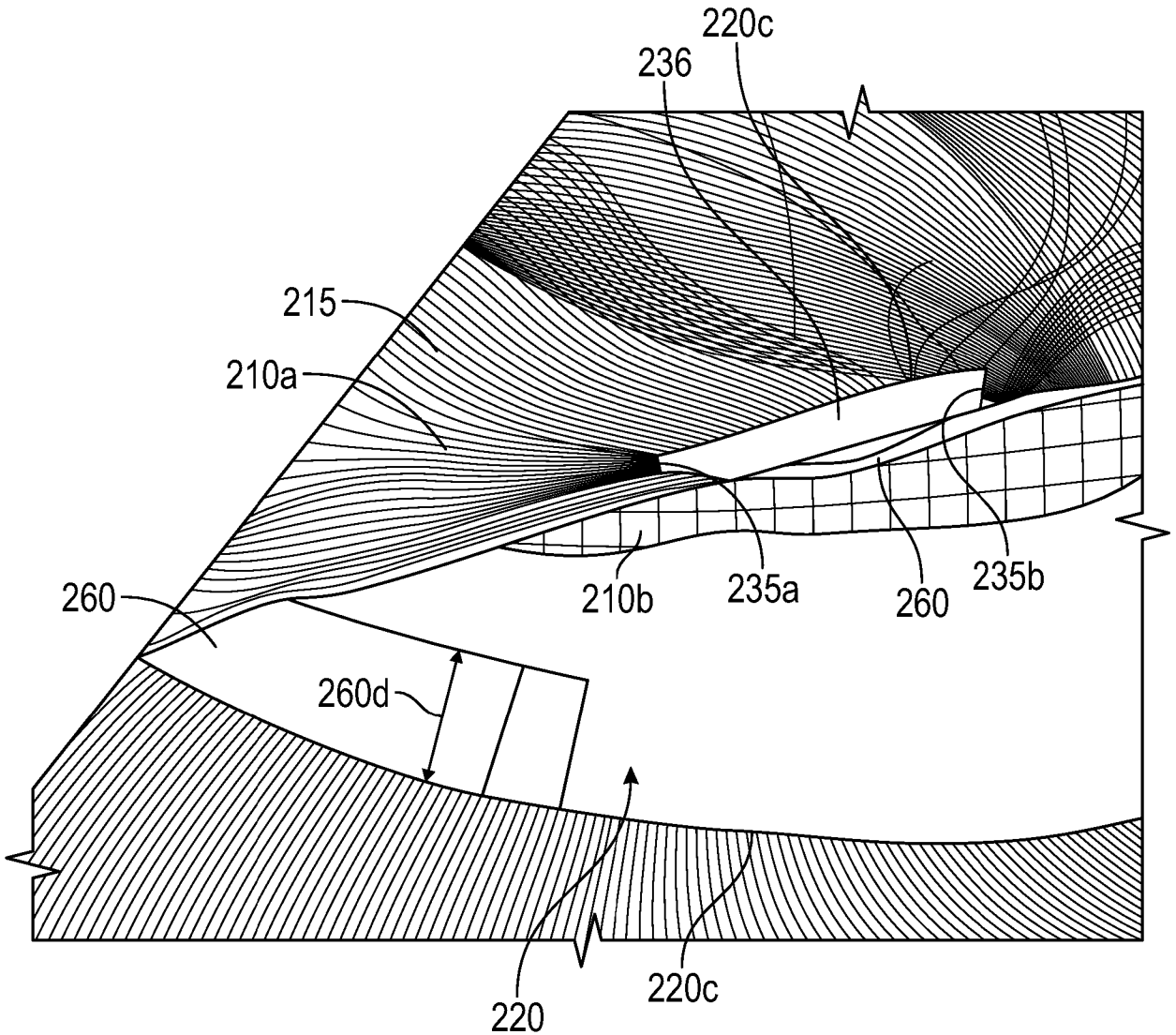
FIG. 13 shows the hair addition of FIG. 7 folded over.

The polymer base 220 has an outer boundary 220*c* and is coupled to the net lower face 210*b* at the entire net perimeter portion 210*d*. The net central portion 210*c* is devoid of the polymer base 220. In some embodiments, the polymer base 220 includes cured polyurethane, with the polyurethane being cured after being applied to the net perimeter portion 210*d*. First and second cuts 235*a*, 235*b* respectively extend from the outer boundary 220*c* through the polymer base 220 and the net 210 (FIG. 13).

Figure 7:
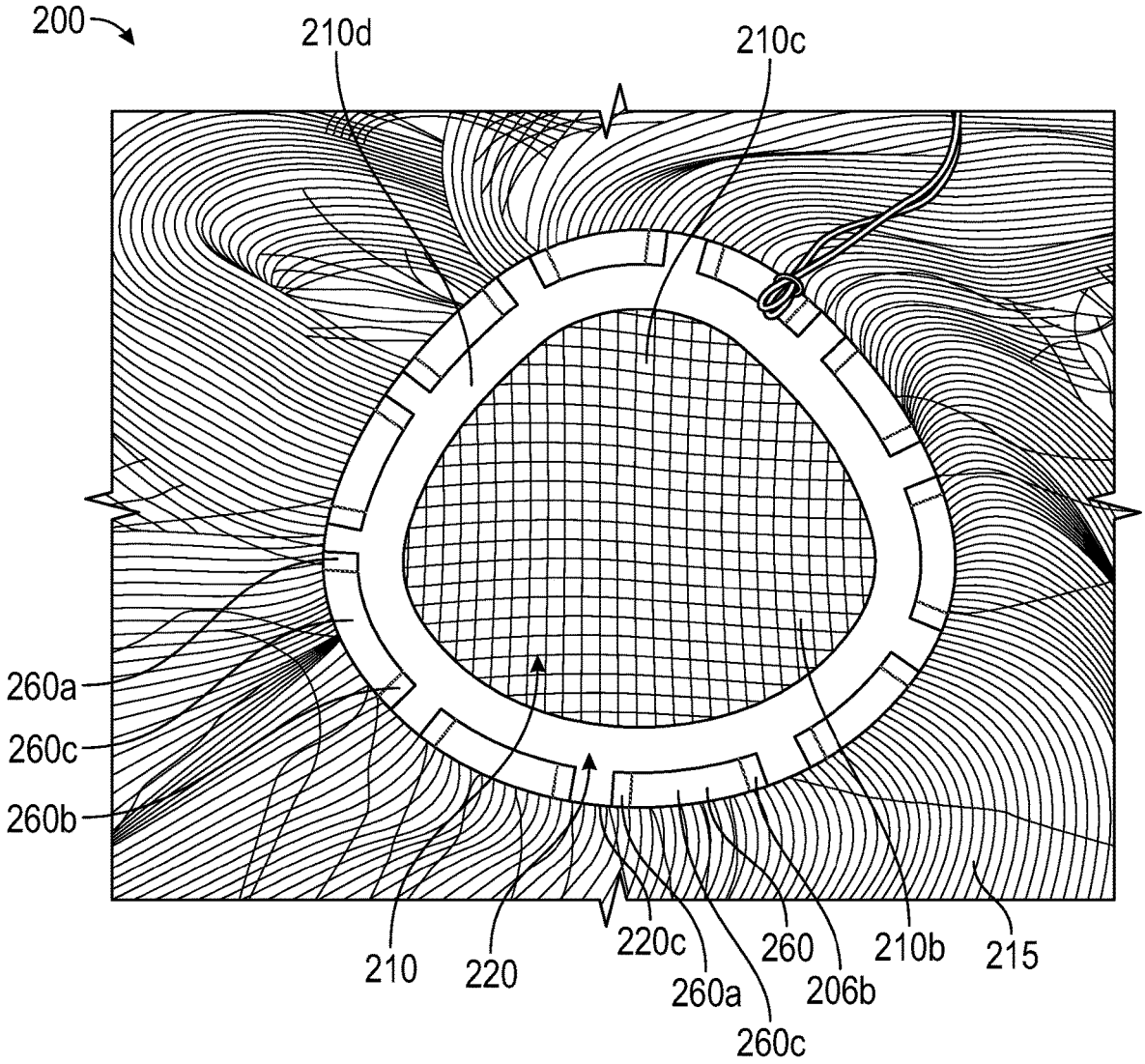
FIG. 7 shows a hair addition according to another embodiment of the current invention, from a bottom side.
Figure 8:
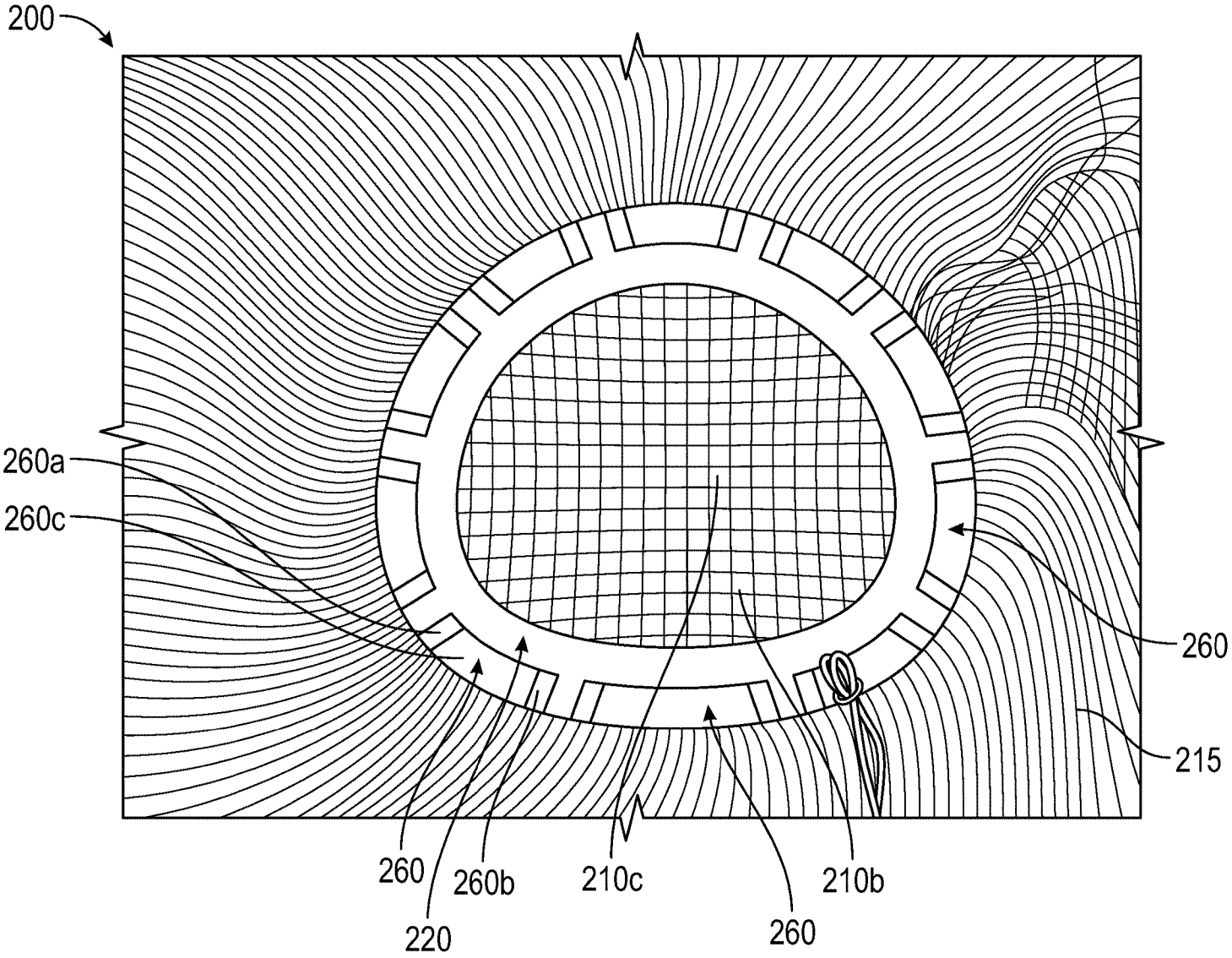
FIGS. 8-12 are bottom views of the hair addition of FIG. 7.
Figure 9:
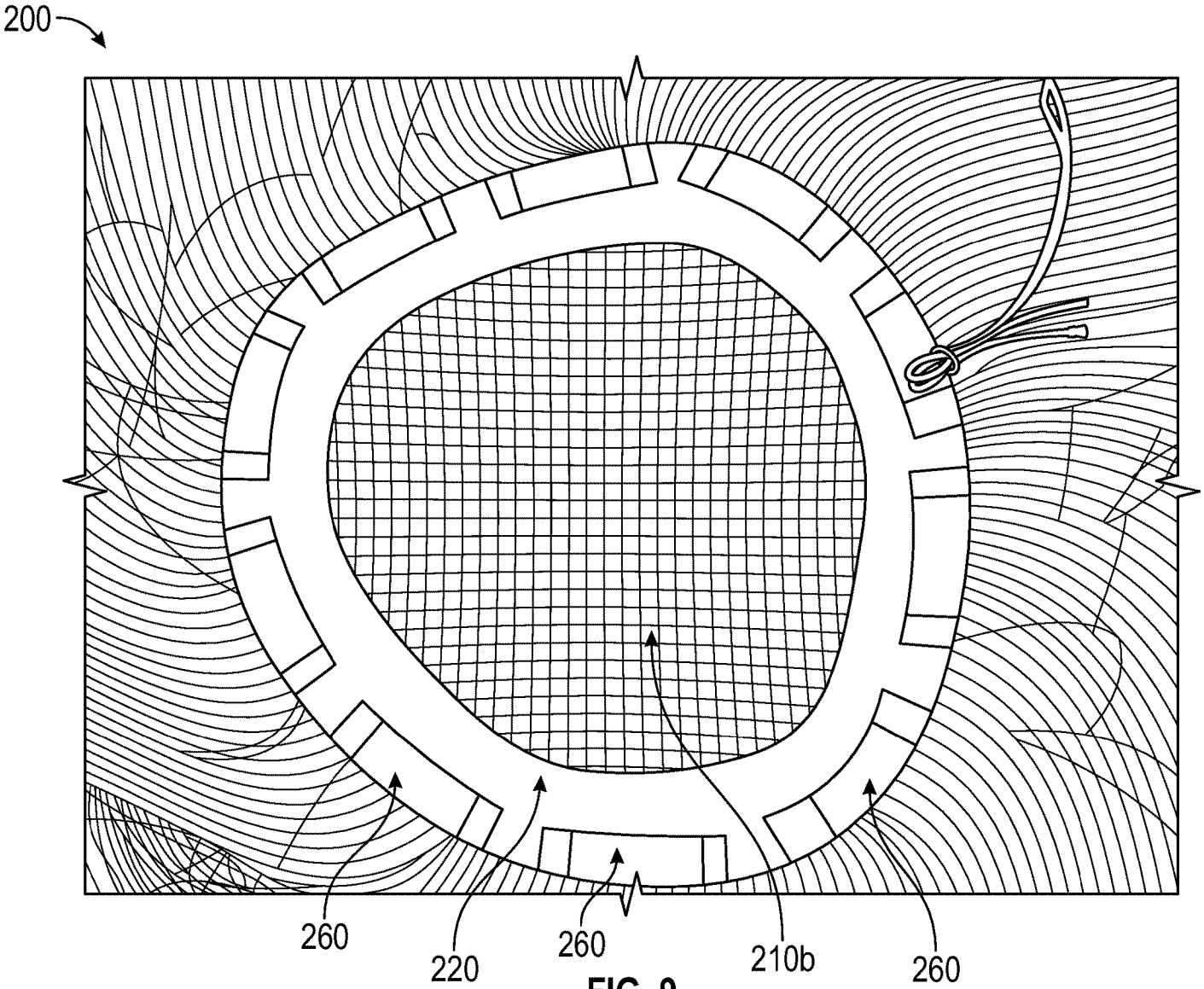
Figure 10:
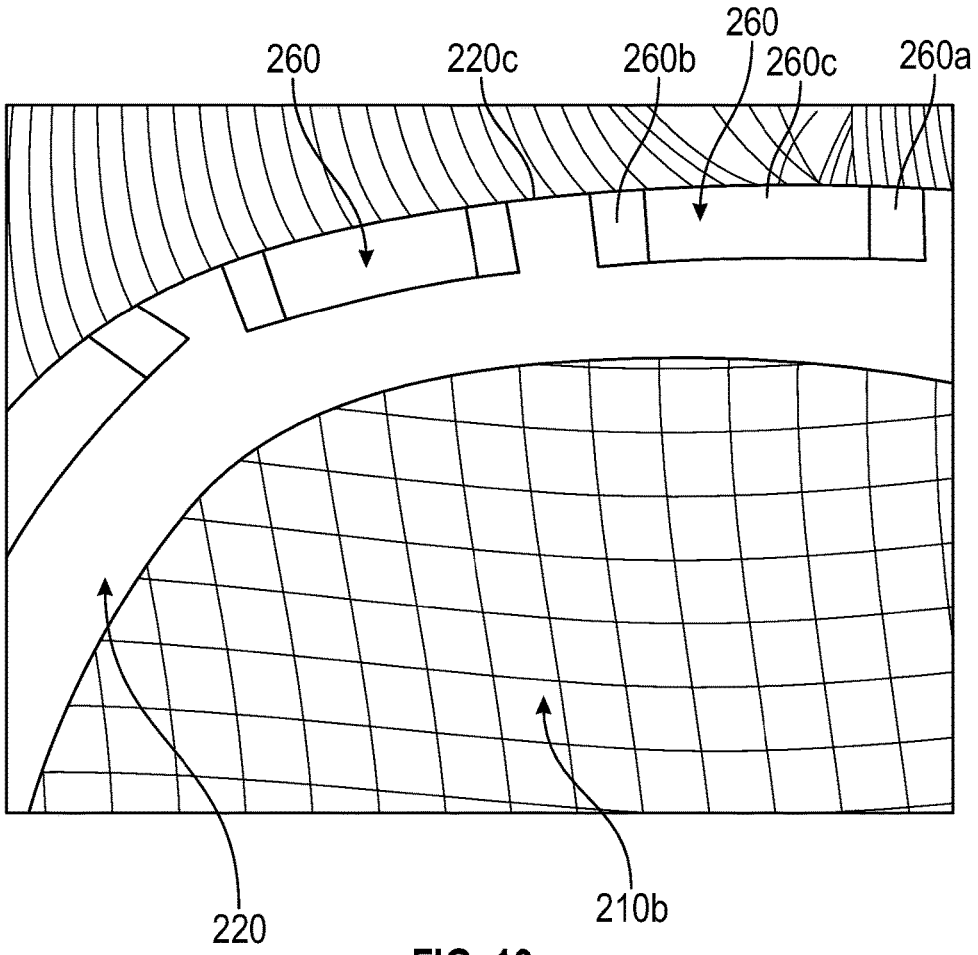
Figure 11:
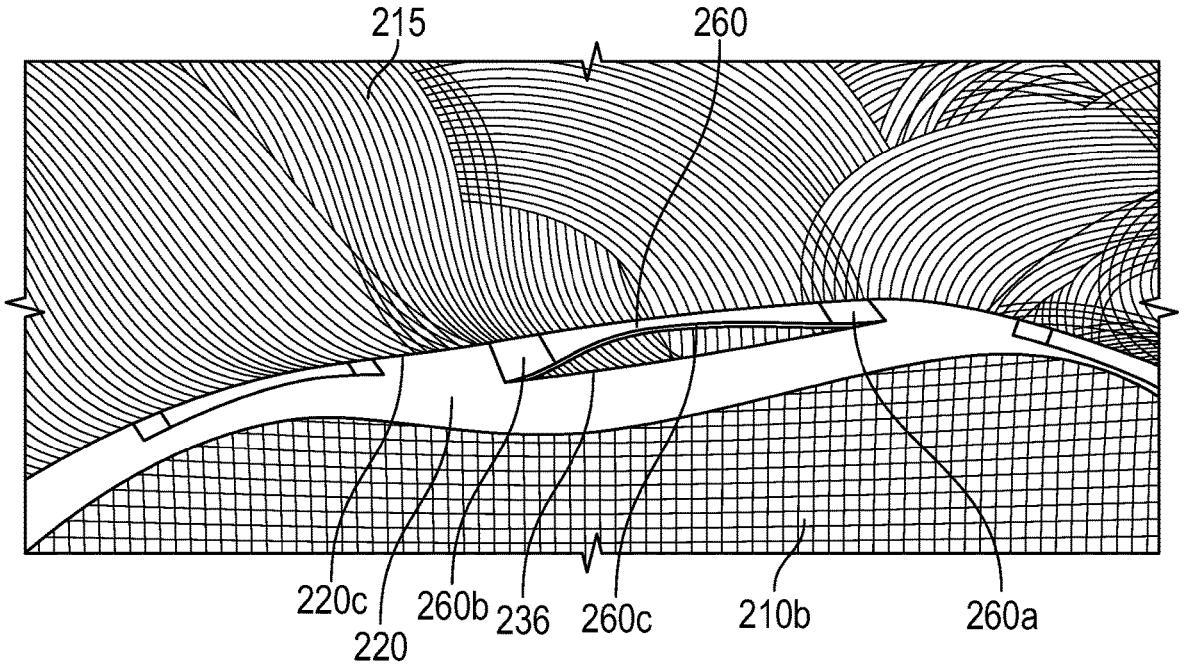
Figure 12:
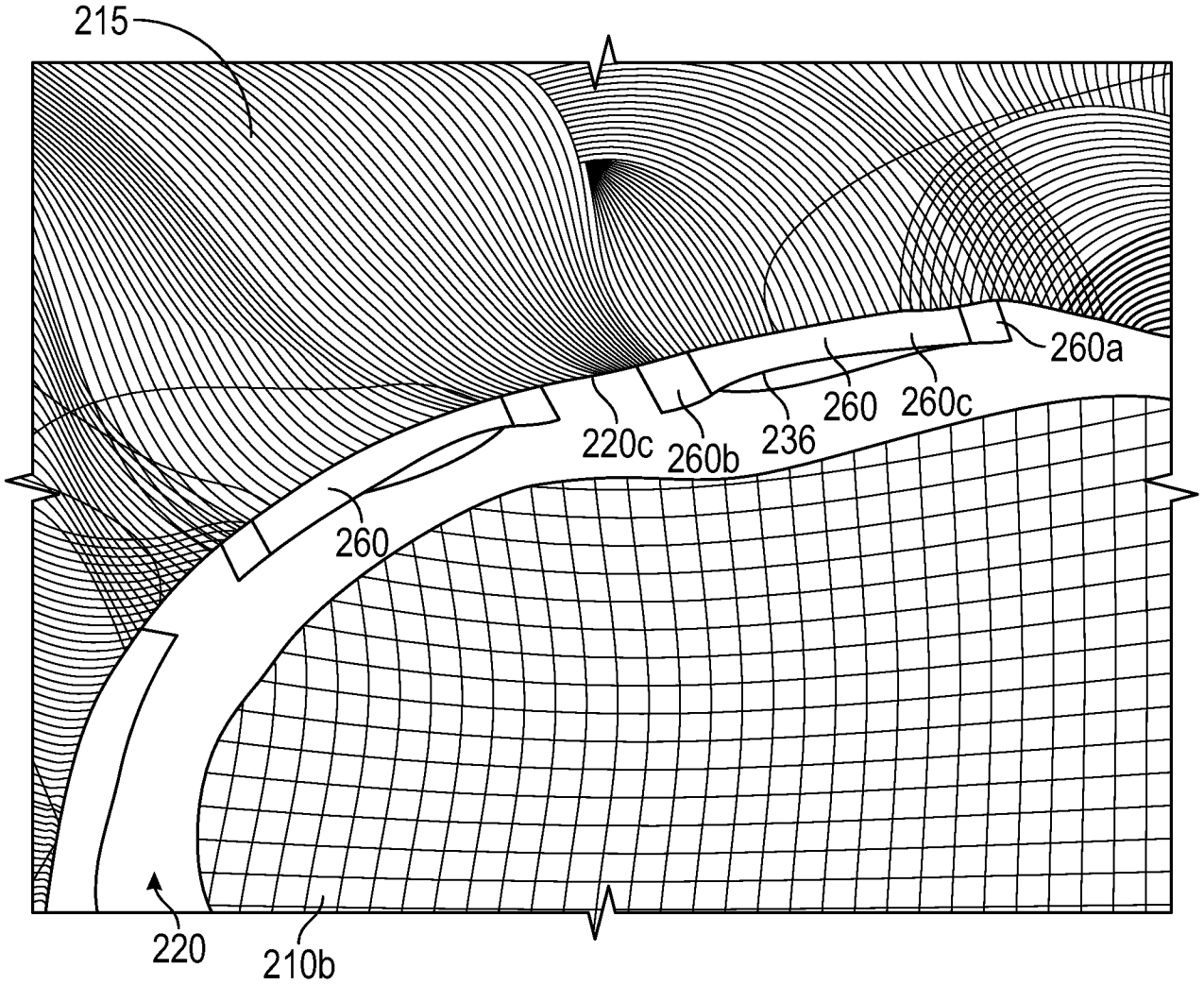

A ribbon 260 has first and second ends 260*a*, 260*b* and a middle portion 260*c*, and the first and second ends 260*a*, 260*b* are fused to the polymer base 220 (FIG. 7). The first and second cuts 235*a*, 235*b* are positioned above the ribbon 260 and define lateral ends of a flap 236 (FIG. 13) overlying the ribbon 260. A width 260*d* (FIG. 13) of the ribbon 260 is generally equal to a length of the first cut 235*a* and to a length of the second cut 235*b*. It may be particularly desirable for the ribbon 260 to be a poly-coated fine monofilament ribbon.

Adhesive may be located between the flap 236 and the ribbon 260 for attaching a wearer's hair passed therebetween to at least one of the flap 236 and the ribbon 260. In some embodiments, the adhesive may be applied to the polymer base 220 before the hair addition 200 is packaged and sold; in such embodiments, temporary coverings (e.g., removable silicone-coated paper backings) may cover the adhesive until the adhesive is to be used. In other embodiments, the adhesive may be later applied by a user.

While this written description generally refers to one flap 236 overlying one ribbon 260 for convenience, the figures illustrate that multiple flap/ribbon pairings may be located along the polymer base 220.

In use, a hair addition 200 having desired properties (e.g., color, length, and shape of the hair strands 215 is selected. The polymer base 220 is positioned atop a wearer's head with the net upper face 210*a* facing away from the wearer's head. As the polymer base 220 is positioned atop the wearer's head, some of the wearer's hair is passed through between the flap 236 and the ribbon 260. The adhesive temporarily fastens the wearer's hair to the flap 236 and the ribbon 260, keeping the hair addition 200 in place on the wearer's head. As will be appreciated by those skilled in the art, this may be repeated for each flap/ribbon combination 236/260, or for a desired portion of the flap/ribbon combinations 236/260. The construction of the hair addition 200 as described and shown may give it a more natural appearance over prior art devices, and may make it more resilient.

Figure 14:
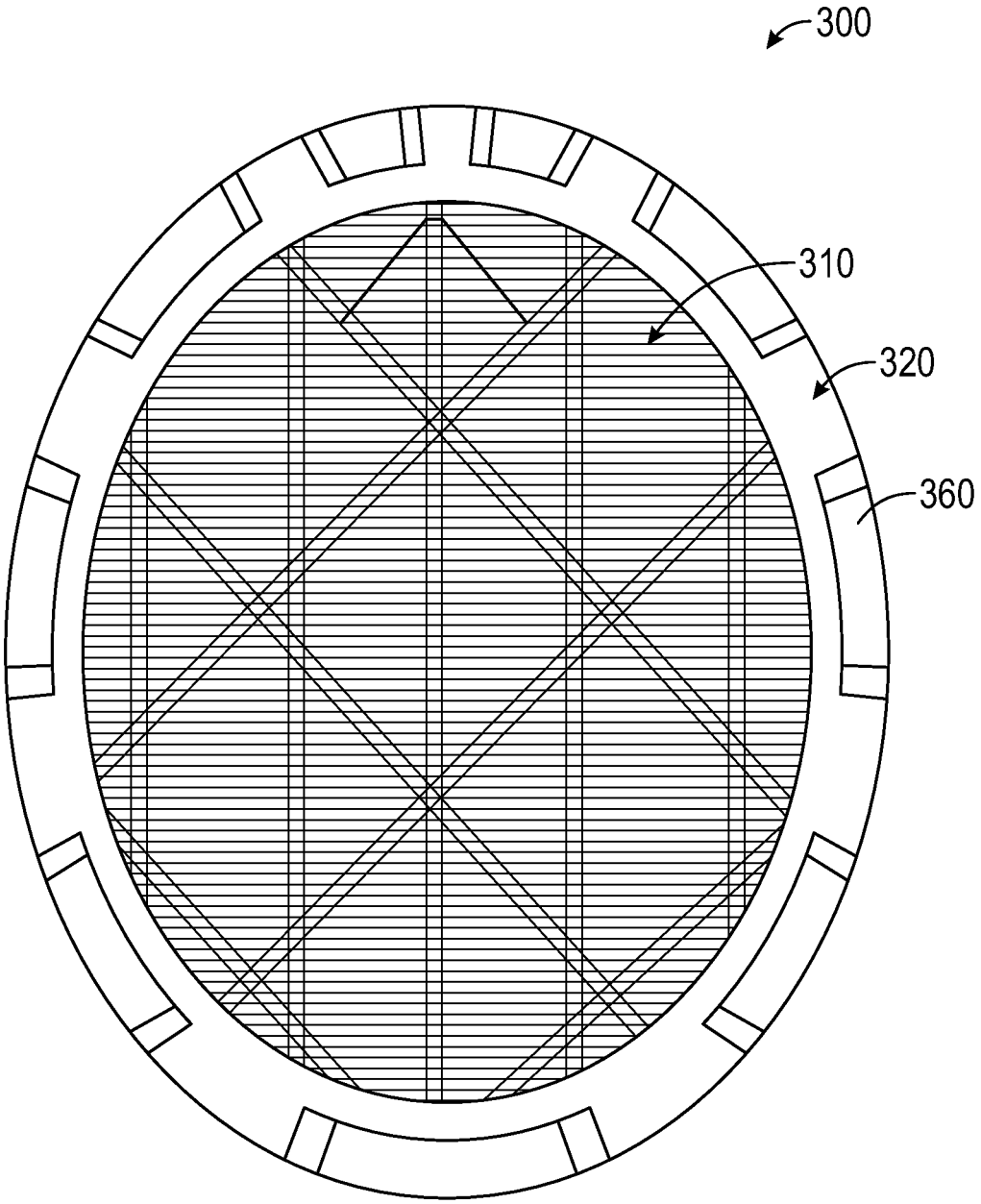
FIG. 14 is a bottom view of a hair addition according to still another embodiment of the current invention, shown without hair.

FIG. 14 discloses a hair addition 300 according to another embodiment of the current invention. The hair addition 300 includes a net 310 substantially similar to the net 110 discussed above, a polymer base 320 substantially similar to the polymer base 220 discussed above (including the flaps 236), and underlying ribbon 360 substantially similar to the ribbon 260 discussed above. Hair strands extend from the net 310 as discussed above regarding the hair strands 115 and the net 110, and the embodiment 300 may either include hair extending from the net 310 above the polymer base 320 or additional hair strands extending from an upper face of the polymer base 320. For clarity, hair is not shown in FIG. 14. Use of the hair addition 300 is substantially similar to use of the hair addition 200 discussed above.

Figure 15:
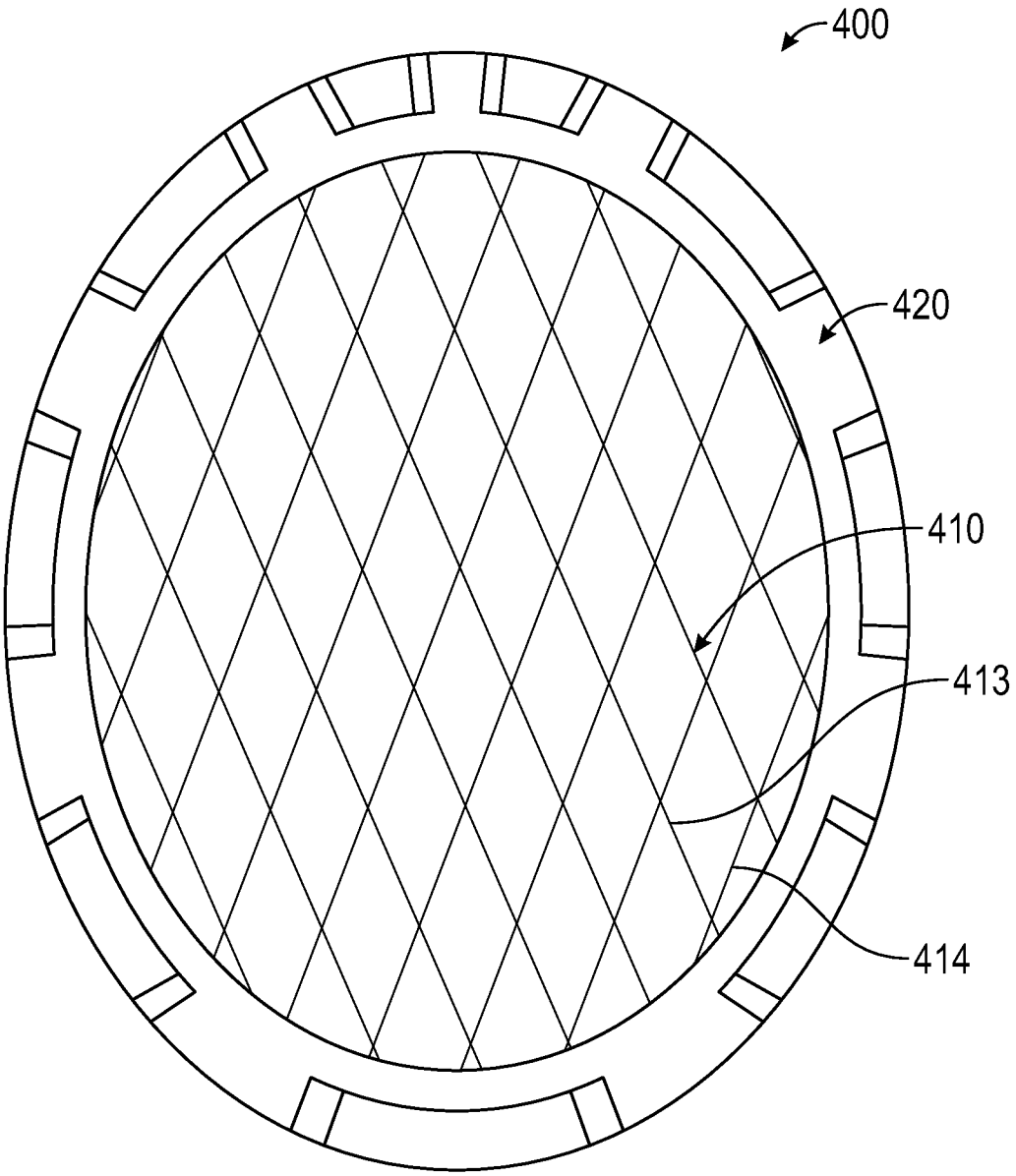
FIG. 15 is a bottom view of a hair addition according to yet another embodiment of the current invention, shown without hair.

FIG. 15 discloses a hair addition 400 according to still another embodiment of the current invention. The hair addition 400 includes a polymer base 420 substantially similar to the polymer base 320 and a net 410. The construction of the net 410 primarily distinguishes the hair addition 400 from the hair addition 300. The net 410 has a row of strands 413 having hair extending therefrom and strands 414 also having hair extending therefrom. For clarity, hair is not shown in FIG. 15. The strands 413, 414 are spaced apart such that the wearer's natural hair may pass therethrough. And except for passing natural hair through the strands 413, 414, use of the hair addition 400 may be substantially similar to use of the hair addition 300 discussed above.

Figure 16:
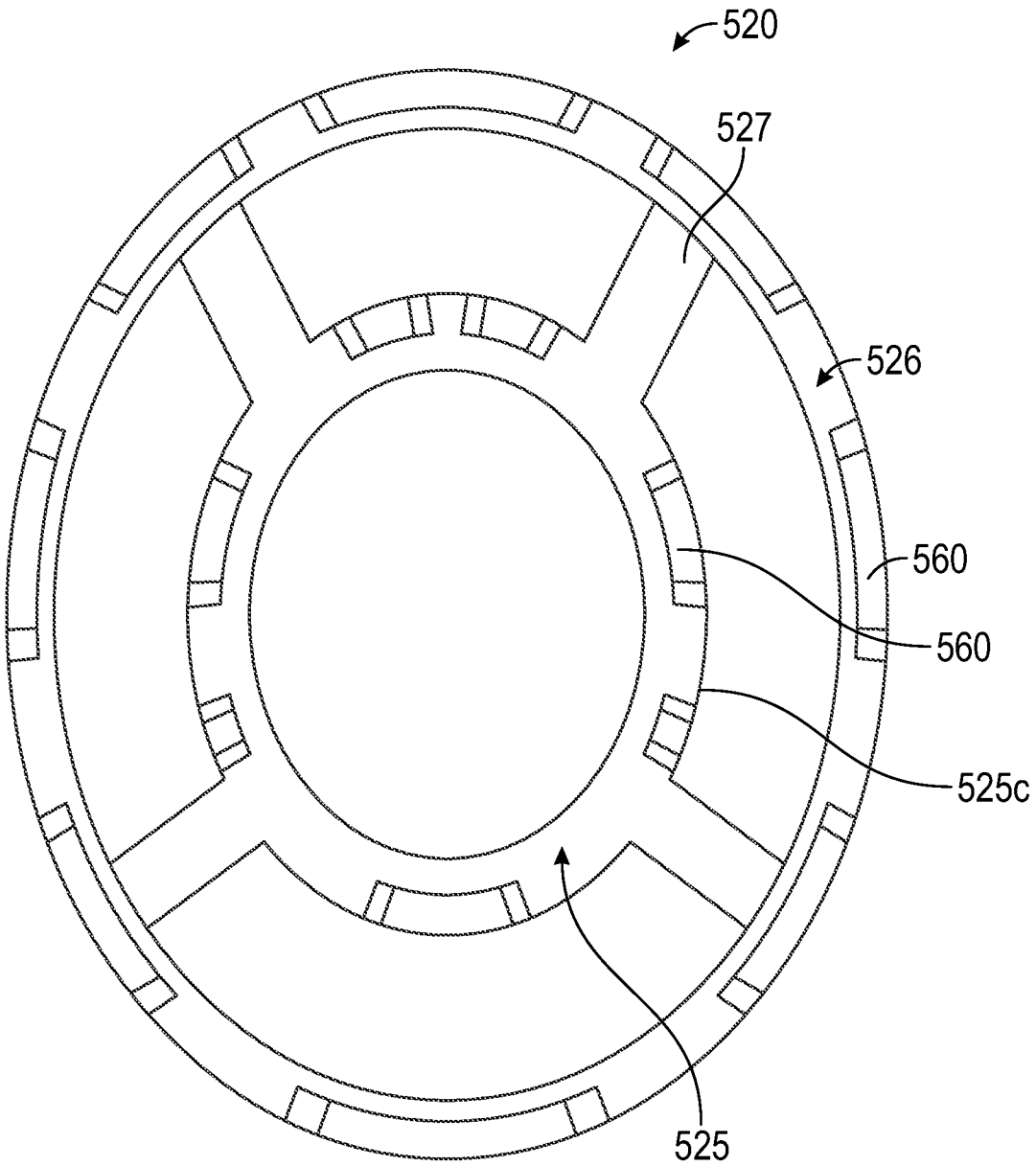
FIG. 16 is a bottom view of a polymer base used in embodiments of the current invention.

FIG. 16 discloses a polymer base 520 used in embodiments of the current invention. More particularly, the polymer base 520 may replace the polymer bases 220, 320, 420 in the hair additions 200, 300, 400 discussed above. The polymer base 520 is substantially similar to the polymer bases 220, 320, 420, except includes an additional internal portion 525 with an outer boundary 525*c*, connected to an outer portion 526 by spans 527. Both the internal portion 525 and the outer portion 526 include ribbon 560 underlying flaps, as discussed above regarding flap/ribbon combinations 236/260. Use of the polymer base 520 differs from use of the polymer bases 220, 320, 420 primarily because some of the wearer's hair is passed through the flap/ribbon combinations in the internal portion 525 (in addition to some of the wearer's hair being passed through the flap/ribbon combinations in the outer portion 526).

Figure 17:
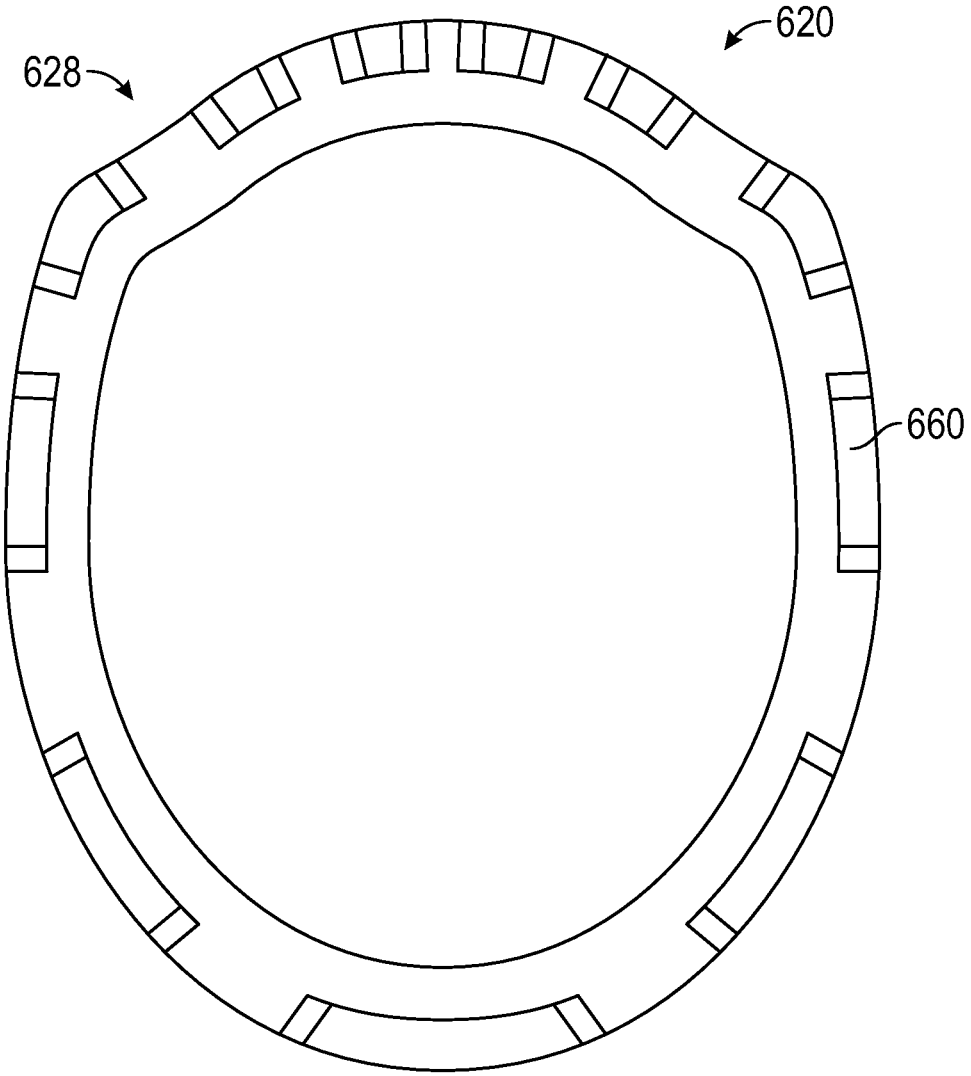
FIG. 17 is a bottom view of a polymer base used in other embodiments of the current invention.

FIG. 17 discloses another polymer base 620 used in embodiments of the current invention. More particularly, the polymer base 620 may replace the polymer bases 220, 320, 420 in the hair additions 200, 300, 400 discussed above. The polymer base 620 is substantially similar to the polymer bases 220, 320, 420 (including the flaps 236 and underlying ribbon 660 substantially similar to the ribbon 260), except the polymer base 620 has an end portion 628 that is shaped differently than in the other polymer bases 220, 320, 420. Use of the polymer base 620 is substantially similar to use of the polymer bases 220, 320, 420 discussed above.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. The specific configurations and contours set forth in the accompanying drawings are illustrative and not limiting.

The invention claimed is:

1. A hair addition, comprising:

a net having a central portion and a perimeter portion encircling the central portion;

a polymer base encasing the net at the entire net perimeter portion, the polymer base having upper and lower faces and a generally uniform total thickness therebetween, the net central portion being devoid of the polymer base;

hair strands extending from the net central portion, the net perimeter portion being devoid of hair strands;

a slot through only a lower thickness of the polymer base;

first and second cuts respectively extending from the slot through only an upper thickness of the polymer base, the lower thickness and the upper thickness combining to define the total thickness, the first and second cuts defining lateral ends of a flap overlaying a strip, the strip having a part of the net perimeter portion contained therein, the flap being devoid of the net; and additional hair strands extending from the polymer base upper face.

2. The hair addition of claim 1, wherein the polymer base comprises cured polyurethane.

3. The hair addition of claim 1, further comprising adhesive between the flap and the strip for attaching a wearer's hair passed through the slot to at least one of the flap and the strip.

4. The hair addition of claim 1, wherein the net comprises:

generally parallel first strands regularly spaced apart at a first distance;

generally parallel second strands, the second strands being generally perpendicular to the first strands;

generally parallel third strands, the third strands being angularly offset between about thirty degrees and about sixty degrees from the first strands; and generally parallel fourth strands, the fourth strands being generally perpendicular to the third strands.

5. The hair addition of claim 4, wherein the hair strands are coupled to the first strands; and wherein the second, third, and fourth strands are devoid of hair strands.

6. The hair addition of claim 5, wherein the polymer base comprises cured polyurethane.

7. The hair addition of claim 6, wherein a density of the additional hair strands is greater than a density of the hair strands.

8. A hair addition, comprising:

a net having a central portion and a perimeter portion encircling the central portion, an upper face, and a lower face;

a polymer base extending below the net lower face at the entire net perimeter portion, the polymer base having upper and lower faces and a generally uniform total thickness therebetween, the net central portion being devoid of the polymer base, the polymer base having an outer boundary;

hair strands extending from the net central portion;

a ribbon having first and second ends and a middle portion, the first and second ribbon ends being fused to the polymer base; and first and second cuts respectively extending from the outer boundary through the polymer base and the net, the first and second cuts being positioned above the ribbon and defining lateral ends of a flap;

wherein the net comprises:

generally parallel first strands regularly spaced apart at a first distance;

generally parallel second strands, the second strands being generally perpendicular to the first strands;

generally parallel third strands, the third strands being angularly offset between about thirty degrees and about sixty degrees from the first strands; and generally parallel fourth strands, the fourth strands being generally perpendicular to the third strands; and wherein the hair strands are coupled to the first strands; and wherein the second, third, and fourth strands are devoid of hair strands.

9. The hair addition of claim 8, wherein the polymer base comprises cured polyurethane.

10. The hair addition of claim 8, further comprising adhesive between the flap and the ribbon for attachment to a wearer's hair passed therethrough.

11. The hair addition of claim 8, wherein a width of the ribbon is generally equal to a length of the first cut and to a length of the second cut.

12. The hair addition of claim 8, wherein the ribbon is a poly-coated fine monofilament ribbon.

13. The hair addition of claim 8, further comprising hair strands extending from the net perimeter portion.

14. The hair addition of claim 8, further comprising additional hair strands extending from the polymer base upper face.

15. The hair addition of claim 14, wherein a density of the additional hair strands is greater than a density of the hair strands.

16. A hair addition, comprising:

a net having a central portion and a perimeter portion encircling the central portion, an upper face, and a lower face;

a polymer base extending below the net lower face at the entire net perimeter portion, the polymer base having upper and lower faces and a generally uniform total thickness therebetween, the net central portion being devoid of the polymer base;

hair strands extending from the net central portion;

a slot through only a lower thickness of the polymer base;

first and second cuts respectively extending from the slot through only an upper thickness of the polymer base, the lower thickness and the upper thickness combining to define the total thickness, the first and second cuts defining lateral ends of a flap overlaying a strip, the strip having a part of the net perimeter portion contained therein, the flap being devoid of the net; and additional hair strands extending from the polymer base upper face.

17. The hair addition of claim 16, further comprising adhesive between the flap and the strip for attaching a wearer's hair passed through the slot to at least one of the flap and the strip.

18. The hair addition of claim 16, wherein the net comprises:

generally parallel first strands regularly spaced apart at a first distance;

generally parallel second strands, the second strands being generally perpendicular to the first strands;

generally parallel third strands, the third strands being angularly offset between about thirty degrees and about sixty degrees from the first strands; and generally parallel fourth strands, the fourth strands being generally perpendicular to the third strands.

19. The hair addition of claim 18, wherein the hair strands are coupled to the first strands; and wherein the second, third, and fourth strands are devoid of hair strands.

20. The hair addition of claim 19, wherein the polymer base comprises cured polyurethane.

21. The hair addition of claim 20, wherein a density of the additional hair strands is greater than a density of the hair strands.

* * * * *